United States Patent [19]

Bingler

[11] 4,130,374

[45] Dec. 19, 1978

[54] CENTRIFUGAL PUMP ASSEMBLY

[75] Inventor: Douglas J. Bingler, Furlong, Pa.

[73] Assignee: Milton Roy Company, St. Petersburg, Fla.

[21] Appl. No.: 823,262

[22] Filed: Aug. 10, 1977

[51] Int. Cl.[2] ..... F01D 7/00

[52] U.S. Cl. ..... 415/131; 415/140; 417/423 R

[58] Field of Search ..... 415/129, 131, 132, 140, 415/141, 34; 417/370, 423 R

[56] References Cited

U.S. PATENT DOCUMENTS

| | | | |
|---|---|---|---|
| 1,012,265 | 12/1911 | Miller | 415/131 |
| 1,404,717 | 1/1922 | Humphrey | 415/131 |
| 1,689,726 | 10/1928 | Jennings | 415/131 |
| 2,010,525 | 8/1935 | McHugh | 415/140 |
| 2,233,268 | 2/1941 | McHugh | 415/131 |
| 2,438,442 | 3/1948 | Holt | 415/140 |
| 2,625,883 | 1/1953 | Howser | 415/131 |
| 3,117,526 | 1/1964 | Zimmermann | 417/370 |
| 3,407,740 | 10/1968 | Samerdyke | 415/131 |
| 3,711,218 | 1/1973 | Kennel et al. | 415/131 |
| 3,771,927 | 11/1973 | Schiller | 415/131 |

*Primary Examiner*—C. J. Husar

*Attorney, Agent, or Firm*—Woodcock, Washburn, Kurtz & Mackiewicz

[57] ABSTRACT

The present invention relates to a centrifugal pump assembly in which an impeller is mounted to a motor shaft without the need for precision machining of the shaft and in which the proper spacing is automatically achieved between the impeller and the pump housing. An end of the motor shaft projects toward an impeller chamber in which a rotary impeller is situated. The impeller hub has a bore therein through which a threaded fastening means passes. The threaded fastening means mates with a threaded well in the end of a motor shaft. However, a coil spring which surrounds the fastening means abuts the shaft end and also abuts the impeller hub. The spring biases the impeller away from the wall of the pump housing and toward the interior of the impeller chamber. The spring prevents the impeller from abutting against the housing wall and the bias of the spring may be adjusted to compensate for variations in the shaft length. Further, the head of the fastening means resides within a recess in the impeller hub, the depth of which is equal to the predetermined spacing required between the impeller and the impeller housing.

9 Claims, 1 Drawing Figure

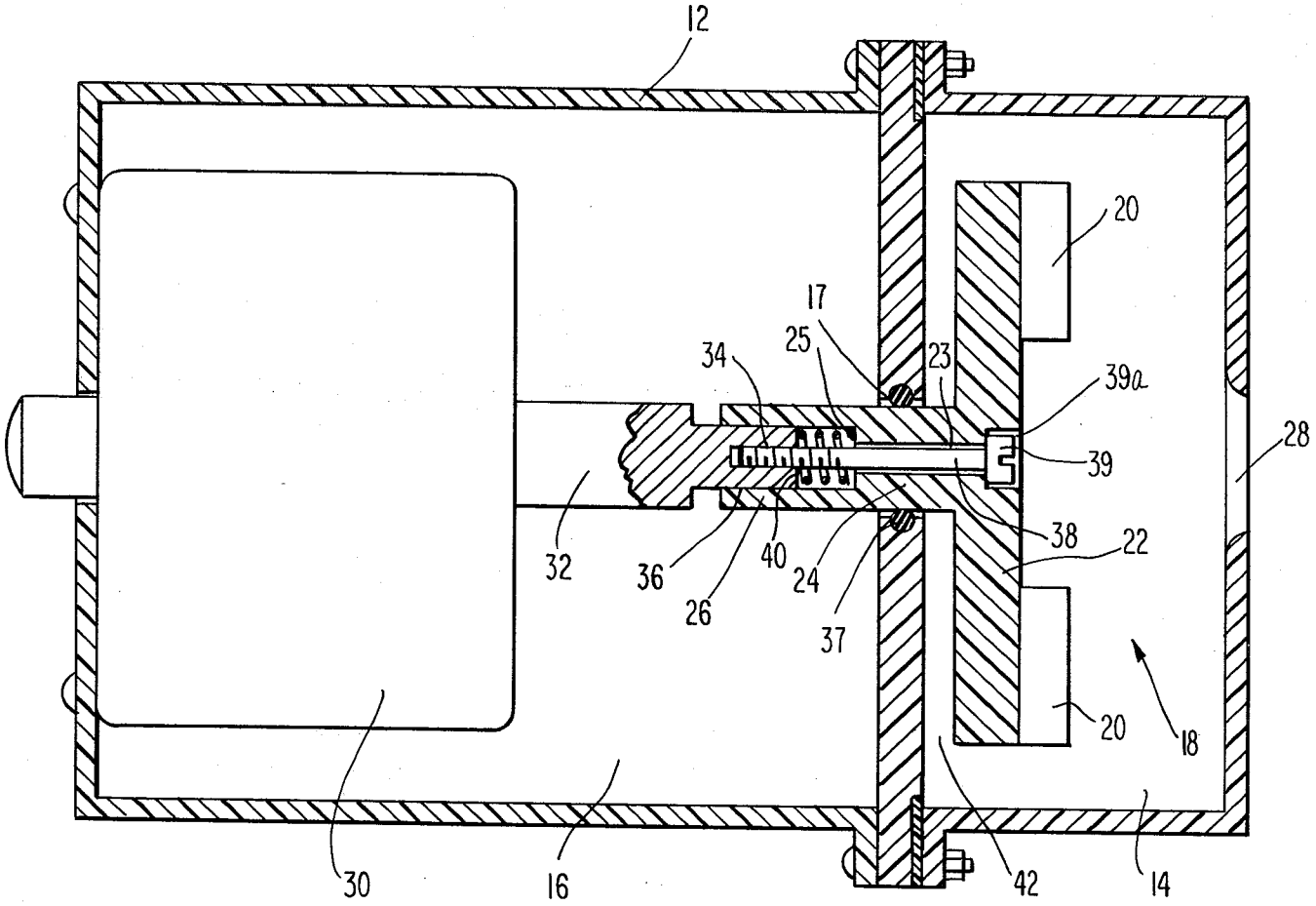
28
18
14
20
39a
39
22
38
20
42
23
17
25
24
37
40
34
26
36
12
32
16
30

CENTRIFUGAL PUMP ASSEMBLY

BACKGROUND OF THE INVENTION

The present invention relates in general to centrifugal pumps and to their method of manufacture, and in particular, it relates to pumps in which an impeller is rigidly mounted to the pump motor shaft.

DESCRIPTION OF THE PRIOR ART

In small, prior art centrifugal pumps, it has been common to extend the shaft driven by a suitable motor toward an impeller chamber. The pump's rotary impeller is then rigidly mounted upon the motor shaft such that rotation of the shaft will be imparted to the impeller.

One common method of attaching an impeller to a motor shaft is disclosed in U.S. Pat. No. 3,117,526 to Zimmerman. Zimmerman discloses a motor shaft projecting into an impeller chamber. The end of the shaft which projects toward the chamber is surrounded by the impeller hub. This end of the shaft has a well therein which is threaded to receive a threaded screw which passes through the center of the hub. The threaded screw mates with the threaded well and thus fastens the hub to the shaft.

One problem associated with this manner of attaching an impeller to a motor shaft is that is requires the impeller shaft to be machined to fairly close tolerances since if the shaft does not project sufficiently toward the impeller chamber, it is not possible to fasten the hub to the shaft. Further, even if the shaft projects sufficiently toward the impeller chamber so that the hub may be mounted to the shaft, it may still be too short thus causing the impeller to closely abut the wall of the pump housing which may thus inhibit its rotation. If the impeller abuts the pump housing during rotation, excessive wear may occur.

One improvement in the impeller mountings over that disclosed by Zimmerman has been to bias the hub of the impeller away from the pump housing and toward the impeller chamber with a spring means. The spring causes the impeller to abut the head of the threaded screw rather than the pump housing. Using this approach, if the motor shaft is not of sufficient length for proper impeller placement, the threaded screw may be backed off and away from the pump housing and since the spring will bias the impeller away from the pump housing, the proper clearance between the impeller and the housing may be provided.

However, even this improved impeller mounting has its drawbacks. When centrifugal pumps are assembled, it is necessary for the clearance between the impeller and the housing to be measured. Once the clearance is measured, the threaded screw is then adjusted to provide the proper pre-determined clearance. This adjustment, since it must be accomplished manually, increases the labor costs of assembling pumps and provides a source of error.

OBJECTS OF THE INVENTION

It is an object of the present invention to provide a centrifugal pump having an impeller which is mounted to a motor shaft such that the need for precision machining of the shaft is eliminated.

It is a further object of the present invention to provide a centrifugal pump which may be easily and inexpensively assembled.

SUMMARY OF THE INVENTION

The present invention achieves these objectives by providing an impeller having a hub portion with a bore therein. The impeller hub is adapted to receive a coil spring, one end of which abuts the end of the motor shaft, and the other end of which abuts the hub. A threaded fastening means projects through the hub bore and the head of the fastening means resides in a recess formed in the hub. The fastening means attaches the impeller to the shaft and also compresses the spring. The spring thus urges the impeller away from the pump housing and causes it to abut the hub of the fastening means and not the pump housing. The distance that the impeller is biased away from the shaft by the spring may be adjusted to compensate for variations in the length of the motor shaft. However, in accordance with the present invention the recess in the impeller hub is chosen such than it equals the proper clearance between the impeller and the housing. Accordingly, when the pump is assembled, the fastening means is adjusted to cause the impeller to tightly abut the housing. The fastening means is then adjusted to be flush with the impeller and then, by allowing the head of the fastening means to enter the recess in the impeller the proper impeller clearance is achieved without the need for measurement or adjustment by the assembler.

DESCRIPTION OF THE PREFERRED EMBODIMENTS

The present invention will be better understood by reference to the accompanying drawing in which the sole FIGURE represents a cross-sectional view of a pump having an impeller mounted in accordance with the present invention.

Referring now to the FIGURE, a centrifugal pump assembly is shown generally at 10. The pump assembly 10 comprises a two-part pump housing 12, the walls of which define separate compartments, an impeller chamber 14 and a motor chamber 16. Communicating between the impeller chamber 14 and the motor chamber 16 is an opening 17.

The impeller chamber 14 is provided with an inlet port 28 and an outlet port (not shown) through which the liquid to be circulated passes.

Situated within the impeller chamber 14 is a rotary impeller shown generally at 18 which is comprised of a blade portion and a hub portion. The blade portion comprises a plurality of impeller blades 20 positioned circumferentially about the impeller 18. Located radially inwardly from the blade portion is a hub portion 22. The hub portion 22 preferably extends from the impeller chamber 14 to the motor chamber 16 through the opening 17 between these chambers. The hub portion 22 is formed to have an axial bore 23 therein. In the preferred embodiment, the hub 22 has a first portion 24 and a second portion 26, the diameter of the bore 23 in the second portion 26 being greater than the diameter of the bore in the first portion 24. Accordingly, a lip 25 is situated at the interfere betwen the first portion 24 and the second portion 26.

Preferably, the pump housing 12 and the impeller 18 are formed of a material which is resistant to chemical attack such as a molded plastic. One particular plastic which has been found to be effective in this regard is polyphenylene oxide.

Situated within the motor chamber 16 is a suitable electric motor 30 which drives a motor shaft 32. One end of the motor shaft projects toward the impeller chamber 14 and this end preferably contains a threaded well 34 therein. Further, in the preferred embodiment, this end of the shaft 32 is formed to have opposing flats 36 which mate with corresponding surfaces on the second portion 26 of the impeller hub 22. The opposing flats 36 allow for the rotation of the motor shaft 32 to be imparted to the impeller 18 without slippage. Those skilled in the art will of course recognize that rather than providing the shaft 32 with opposing flats 36, only a single flat surface is required. Further it would be possible to provide a shaft 32 having a splined end mating with a keyway in the bore of the impeller 18.

Located at the opening 17 between the impeller chamber 14 and the motor chamber 16 a sealing means such as an "0" ring 37 may be provided which prevents fluid in the impeller chamber 14 from reaching the motor chamber 16.

The impeller 18 is attached to the motor shaft 32 by means of a fastening means 38 such as a threaded screw as shown. The head 39 of the fastening means 38 rests in a recess **39*a* formed in the hub portion 22 of the impeller 18. Further, the fastening means 38 projects through the bore 23 of the hub portion 22 of the impeller 18 and mates with the threaded well 34 of the motor shaft 32**.

Situated between the motor shaft 32 and the hub portion 22 is a spring means 40 such as a coil spring which abuts the end of the motor shaft 32 and the lip 25 of the first portion of the impeller hub 22. This spring means biases the impeller 18 away from the pump housing 12, and againt the head 39 of the fastening means 38, thus allowing a gap 42 to exist beteen the impeller blade portion and the pump housing 12.

The presence of the gap 42 prevents wear between the impeller 18 and the pump housing 12 as the impeller 18 rotates. Further, the width of the gap 42 may be adjusted by adjusting the fastening means 38 thus altering the bias of the spring means 40. In this way, compensation may be made for variations in the length of the motor shaft 32.

In accordance with the present invention, the depth of the recess **39*a* formed in the impeller 18 is chosen to exactly equal the width of the gap 42. Accordingly, when the pump of the present invention is assembled, the impeller 18 is inserted over the motor shaft 12 such that the spring means 40 is completely compressed. The fastening means 38 is then adjusted such that the head 39 of the fastening means 38 is flush with the impeller 18 without entering the recess 39*a*. Then, by allowing the spring means 26 to expand, the head will enter the recess 39*a* and the proper clearance at the gap 42** will automatically be obtained.

While a particular embodiment of the present invention has been shown and described, it will, of course, be understood that various modifications may be made without departing from the principles of the present invention. The appended claims are, therefore, intended to cover any such modifications within the true spirit and scope of the invention.

What is claimed is:

1. A centrifugal pump assembly comprising:

a pump housing defining an impeller chamber therein;

a motor shaft, one end of which projects towards said chamber;

an impeller having a blade portion and a hub portion, said hub portion having a bore therethrough and a recess therein, said blade portion being separated from said housing by a predetermined distance said distance equaling the depth of said recess;

a fastening means projecting through said bore to said end for mounting said impeller to said shaft, said fastening means having a head portion adapted to be received within said recess; and a spring means biasing said impeller away from said shaft and toward the interior of said chamber.

2. The pump of claim 1 wherein said one end of the motor shaft has a threaded well therein and wherein said fastening means is threaded to mate with said well.

3. The pump of claim 2 wherein said spring means comprises a coil spring which surrounds the fastening means and which abuts the shaft end and said impeller hub.

4. The pump of claim 3 wherein said hub comprises a first portion with a bore of a first diameter and a second portion with a bore of a second diameter, said second diameter being greater than said first diameter and wherein said spring abuts said hub at the interface between said first portion and said second portion.

5. The pump of claim 4 wherein said second portion surrounds said shaft end.

6. The pump of claim 5 wherein said shaft has a flat surface and wherein said second portion has a surface which mates with said flat surface.

7. The pump of claim 5 wherein said shaft end has opposing flats and wherein said second portion has surfaces mating with said flats.

8. The pump of claim 4 wherein said shaft is splined and wherein said second portion contains a keyway mating with said shaft.

9. The pump of claim 6 wherein said impeller is biased against said fastening means.

* * * * *